US007410454B1

(12) United States Patent
Levine

(10) Patent No.: US 7,410,454 B1
(45) Date of Patent: Aug. 12, 2008

(54) LOOSE FILL PACKING MATERIAL AND APPARATUS FOR MANUFACTURING SAME

(76) Inventor: Norman D. Levine, 2731 NE. 14th St., Apt. B119, Pompano Beach, FL (US) 33061

( * ) Notice: Subject to any disclaimer, the term of this patent is extended or adjusted under 35 U.S.C. 154(b) by 22 days.

(21) Appl. No.: 10/710,446

(22) Filed: Jul. 12, 2004

(51) Int. Cl.
*B31B 49/00* (2006.01)

(52) U.S. Cl. ..... 493/373; 493/342; 493/358; 493/967

(58) Field of Classification Search ..... 493/340, 493/342, 352, 353, 354, 357, 358, 369, 370, 493/373, 464, 967
See application file for complete search history.

(56) References Cited

U.S. PATENT DOCUMENTS

| | | | | |
|---|---|---|---|---|
| 1,943,752 | A | 1/1934 | Wick | |
| 3,856,217 | A | 12/1974 | Brewer | |
| 3,963,181 | A | 6/1976 | Deloy et al. | |
| 4,041,816 | A | 8/1977 | Shearon | |
| 4,070,202 | A | 1/1978 | Nollet | |
| 4,168,034 | A | 9/1979 | Leger | |
| 4,460,131 | A | 7/1984 | Cerroni | |
| 4,809,915 | A | 3/1989 | Koffsky et al. | |
| 4,867,866 | A | 9/1989 | Mayberry | |
| 5,024,862 | A | 6/1991 | Frank | |
| 5,035,164 | A | 7/1991 | Cremona | |
| 5,156,075 | A | 10/1992 | Campbell, Jr. et al. | |
| 5,163,627 | A | 11/1992 | Bouche | |
| 5,193,753 | A | 3/1993 | Menges | |
| 5,312,665 | A | 5/1994 | Pratt et al. | |
| 5,339,961 | A | 8/1994 | Mayhak | |
| 5,340,034 | A | 8/1994 | Jang | |
| 5,340,638 | A | 8/1994 | Sperner | |
| 5,358,187 | A | 10/1994 | Ward | |
| 5,472,779 | A | 12/1995 | Cann et al. | |
| 5,533,955 | A | 7/1996 | Cann et al. | |
| 5,637,071 | A * | 6/1997 | Simmons et al. | 493/464 |
| 5,906,569 | A * | 5/1999 | Ratzel | 493/363 |
| 6,425,323 | B1 * | 7/2002 | Steuer | 100/90 |

* cited by examiner

*Primary Examiner*—Christopher Harmon
(74) *Attorney, Agent, or Firm*—Malin Haley DiMaggio Bowen & Lhota, PA

(57) ABSTRACT

This invention forms a loose fill packing material comprising clean, elongated strips of paper formed from corrugated cardboard having internal fluting formatted to expand in height, improving the ability of the strips to lattice. A vertical slitter divides cardboard into blanks of a predetermined width generally with the grain of corrugation. The blanks are fed into a shredding device that cuts the blanks with a scissor motion across the width of the blank. The strips pass onto a cleated perforated conveyor and into an enclosed suction housing. Inside the suction housing is a vortex box enhancing air flow for cleaning the strips. Strips are centered on the conveyor. The strips move from the conveyor to an angled, vibrating sifter plate into a collector. Strips are sprayed with a liquid material having microbicidal, sanitizing, insect repellant, disinfectant and/or deodorizing properties.

32 Claims, 9 Drawing Sheets

LOOSE FILL PACKING MATERIAL AND APPARATUS FOR MANUFACTURING SAME

BACKGROUND OF INVENTION

1. Field of the Invention

This invention relates to an apparatus for converting corrugated cardboard boxes into loose fill packing material comprising elongated strips of cardboard which are substantially free of dirt, dust and other contaminants, and, which are coated with a liquid material having microbicidal, sanitizing, insect repellant, disinfectant and deodorizing properties.

2. Description of Related Art

There is a wide variety of packing materials, including Styrofoam peanuts. However, items packed in peanuts tend to shift, settle or creep within a container in the course of shipment. Also, the peanuts tend to move relative to one another, thereby permitting the packed items to shift.

This problem of shifting has been solved to some extent by the use of other packing materials in addition to or as a replacement for the Styrofoam peanuts. For example, "bubble-wrap" has also been used as an addition to or a substitute for Styrofoam peanuts. Unfortunately, bubble-wrap is also expensive and can be difficult to work with depending upon the size, shape and/or weight of an item to be shipped.

An issue with foam packing materials is that they promote the formation of static electricity within the container. The static can create substantial problems with sensitive electrical components. Additionally, electrostatically charged material attracts contaminants and other impurities which make their use undesirable for certain hygienic applications. Furthermore, the statically charged materials are difficult to handle, as the static charge causes the pieces of fill to repel each other.

Plastic packing materials create a disposal problem and can be dangerous to the environment. They use resources to create and do not readily biodegrade when placed in a landfill. Additionally, leaching can take place with certain plastics, thereby creating environmental hazards. Several states have considered laws to reduce or eliminate the dumping of plastics within sanitary landfills and this could pose a significant disposal problem. Also, plastic packing materials are non-absorbent if liquid leakage occurs during shipment. Another problem with Styrofoam is that they are impractical when shipping heavy objects, because the pieces of fill may break.

Also, cardboard strips used to protect packaged goods have several problems associated with it. However, current methods are inefficient in the manufacture of the fill. In addition, a large amount of tabs and odd shaped pieces are formed with the fill, causing interference with the latticing effect of the strips and breakdowns and increased maintenance of the apparatus. In addition, Furthermore, the dirt and dust raised by current methods make the fill material inappropriate for applications where cleanliness in the material is desired.

SUMMARY OF INVENTION

It is therefore among the objectives of this invention to provide a fill which is environmentally safe, readily biodegradable, efficient to manufacture, diminishing in the formation of static electricity, exhibitive of good insulating properties, shock-absorbing, handling of heavy objects and possessing superior encapsulating properties. Other objectives of this invention include the provision of an apparatus for manufacturing fill that can absorb liquid leakage. The fill may be dyed colors or sprayed with beneficial chemicals and not lose integrity. The fill may be easily used and picked up and placed without the problems associated with static electricity.

Other objectives include the provision of an apparatus for manufacturing fill which is easy to operate and maintain, and which can operate on 110 volt, or three-phase power. Another objective is the pre-slitting of cardboard into blanks in the same direction as the corrugation, which can be varied in length to the preference of the user. The fill is to have a latticing effect, and have substantially no dust, dirt or other contamination. The fill is of uniform size, and have treatment which adds to the safety and the cleanliness of the material. The fill is also dyed to any desired color.

These objectives are accomplished in an apparatus for forming fill which comprises a vertical slitter device to create a blank of a predetermined width and a portable or stationary cutting and shredding mechanism operative to convert corrugated cardboard blanks into elongated, thin paper strips with expanded arch fluting which are discharged onto a cleated perforated conveyor movable between a loading position at the shredding mechanism and a discharge position where the paper strips are emptied into a bag or box. A suction housing creates a downward positive pressure of airflow on the fill. The suction housing is mounted at the outlet of the shredding mechanism in position to substantially enclose the conveyor so that suction can be drawn over the paper strips to remove dirt, dust and other foreign materials therefrom.

Suction is provided below a perforated conveyor. The suction is preferably provided in a housing which creates a vortex to improve the cleaning ability of the air moving through the perforated conveyor.

After exiting the suction housing, the cleaned paper strips are moved by the conveyor to an angled plate which preferably has a plurality of openings which are optimized to allow undesired, short strips of paper or other contaminants to pass therethrough. The paper strips are discharged from the plate into a collection hopper. Preferably, a spraying device is provided to deposit a liquid material onto the paper strips having microbicidal, sanitizing, insect repellant, disinfectant and deodorizing properties.

One aspect of this invention is predicated upon the concept of providing an efficient and economical apparatus for the formation of cleaned and sanitized paper material strips from sections or sheets of used corrugated, cardboard boxes which would otherwise be disposed of in a landfill. This invention allows businesses to cheaply and easily recycle corrugated cardboard without wasting valuable space and while reducing operating costs.

The paper strips are formed from slit cardboard blanks. Guides and rollers secure the blanks entering the shredding device to minimize tabs and irregular cuts. The preferred scissor cut shearing motion makes a clean and efficient cut of the blanks entering the shredding device. The strips are then treated by positive and negative airflow, providing a synergistic effect to remove, dust, dirt and contaminants as they exit the shredder device. In the event any short paper strips are formed in the shredding operation, such shorter strips are removed in the course of passage along the vibrating sifter plate. The remaining paper strips are then spray treated to further ensure that the packing material is clean and suitable for predetermined uses.

The product of the apparatus of this invention has a number of advantages over Styrofoam peanuts, blow-in foam materials, air pillows, bubble-packaging and similar plastic packing materials. The paper strips formed by the apparatus herein are readily biodegradable and environmentally safe. The paper strips herein are denser and stronger than the light-weight, Styrofoam peanuts currently used in many loose fill packaging applications which makes them easier to handle and collect, both during the packing operation and when the item is removed from the shipping container. Furthermore, the strips of the present invention form latticework to produce a locking effect due to the expansion of the corrugation of the strips. The expansion occurs because pressure is released from the top and bottom liner boards of the corrugated cardboard in the formation of the strips. The strips also conform to the shape of the item being shipped and substantially resist shifting, settling or creeping of the item within the container in the course of shipment while providing superior insulation and shock absorption properties.

Additionally, the paper strips herein formed from corrugated cardboard boxes do not promote the formation of an electrostatic charge and need no antistatic agents in order to safely ship sensitive electrical components. Further, strips are able to handle both heavy and light loads and are absorbent in case of accidental leakage. The easy maintenance and efficiency of the present invention makes the use of strips more tenable for businesses, thereby helping save the environment though the use of more recycled product in the stream of commerce. The compactness of the apparatus allows the fill to be used in businesses having smaller areas to operate. The well cleaned fill of the present apparatus may be used for operations that previously would not use fill. Also, the overall cost of the paper strips of this invention is reduced.

The present fill is an improvement over the prior art because it reduces breakage of the items shipped, it can be disposed of by the customer with normal cardboard disposal equipment or containers, and/or the paper strips can be reused by receivers of packages in subsequent shipping applications. Also, the strips are representative of voluntary market driven recycling. The strips are also useful as seed cover, insulation, mulch, animal bedding, artificial firelogs and gift basket fill.

In accordance with these and other objects which will become apparent hereinafter, the instant invention will now be described with particular reference to the accompanying drawings.

DETAILED DESCRIPTION

Figure 1A:
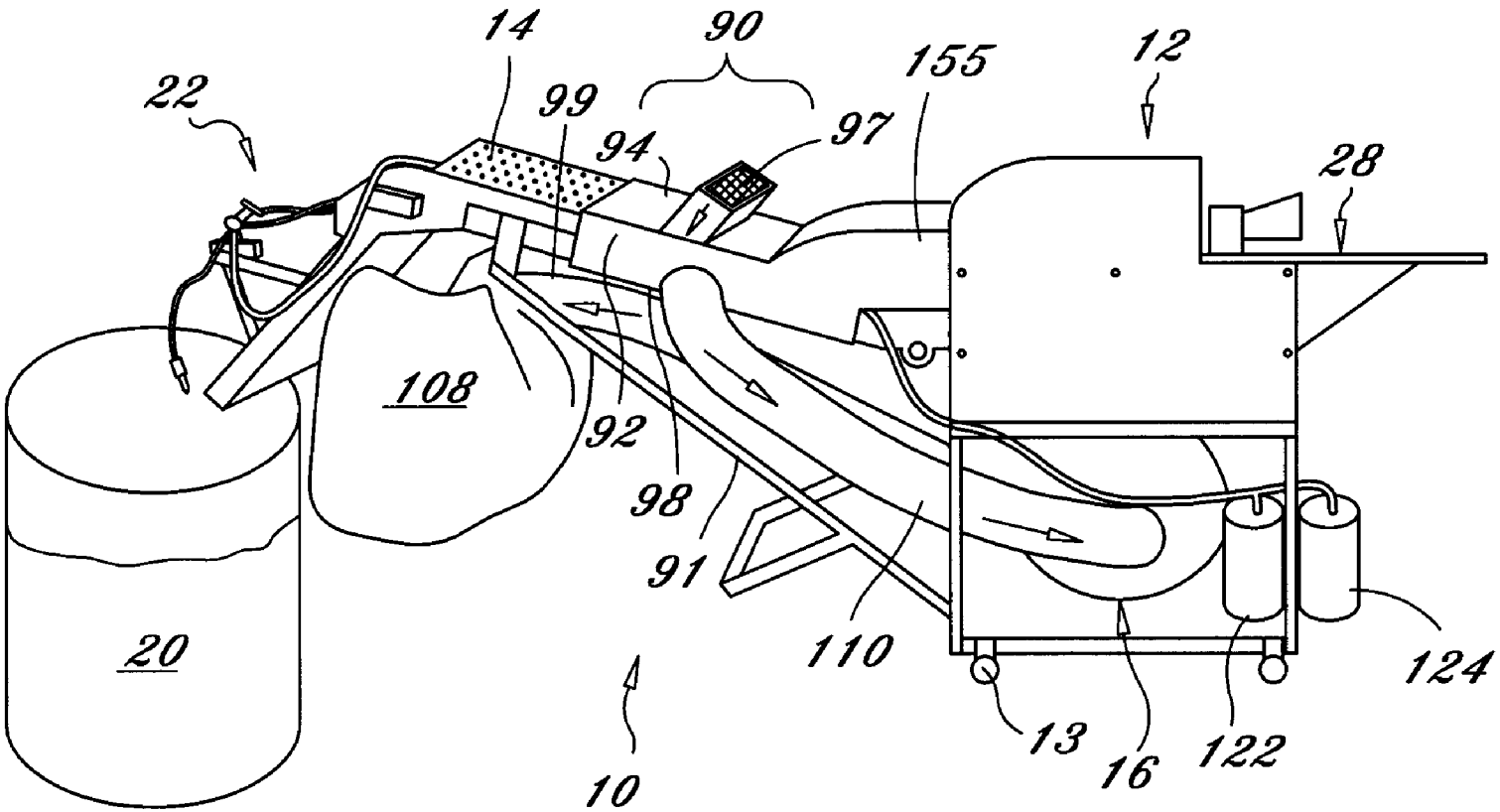
FIG. 1 shows a side schematic view of the preferred embodiment of the invention having a bag stand.
Figure 1B:
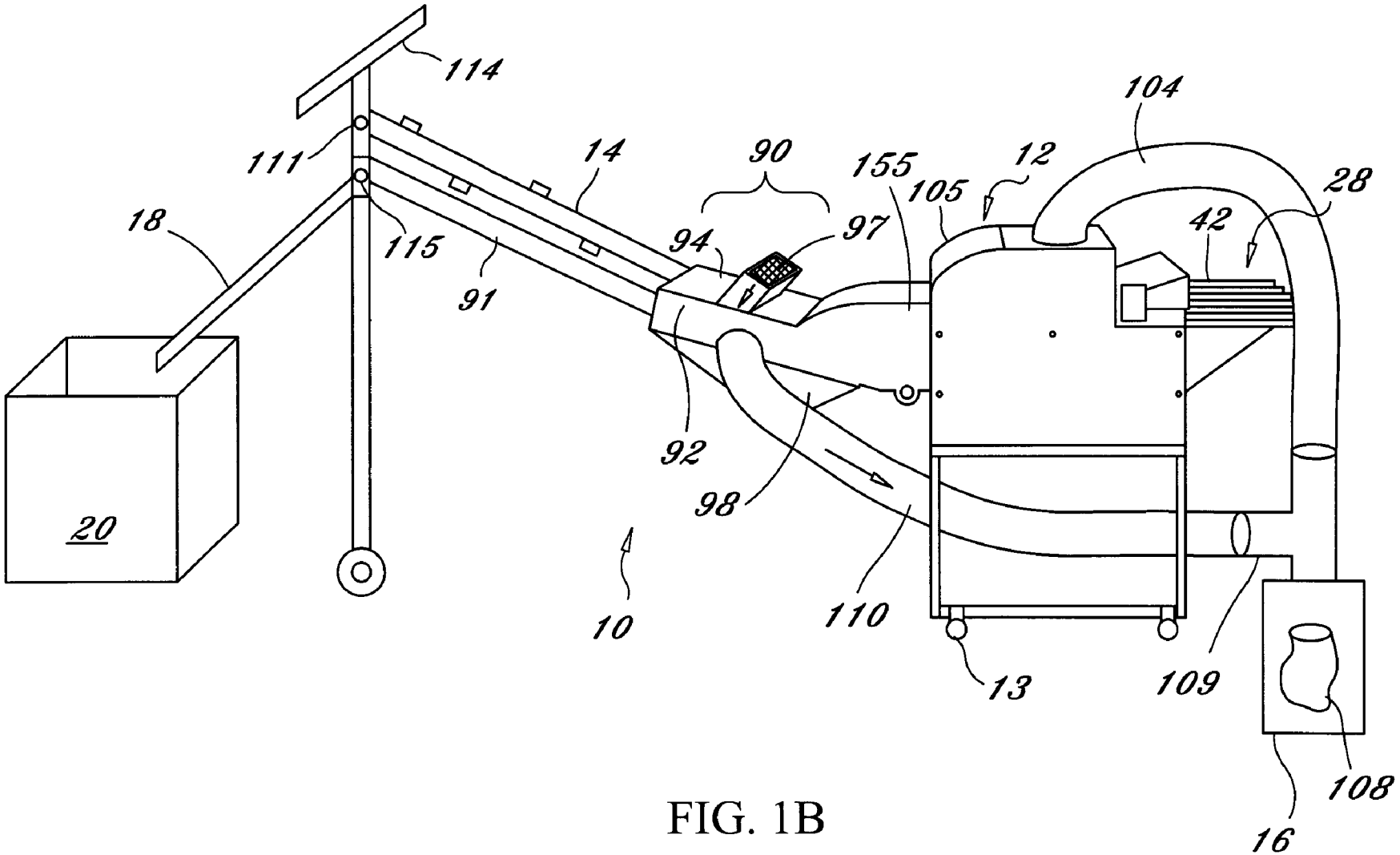

Referring now to FIGS. 1A and 1B, the apparatus 10 of this invention is described generally at 10. The apparatus 10 comprises a shredding mechanism 12, a conveyor 14, and a suction device 16. In one embodiment, a generally flat plate 19 directs the product strips into a bag or hopper 20. In an embodiment used for high volume, shown in FIG. 1B, a sifter plate 18 directs the strips to the bag or hopper 20.

A slitter device (not shown), either portable or attached to the shredder device 12, is preferably included as part of the apparatus 10. Throughout this application, the term shredding shall mean the creation of small pieces, which is preferably performed by a unique cutting process to reduce the formation of dust in the operation of the present invention.

Figure 2:
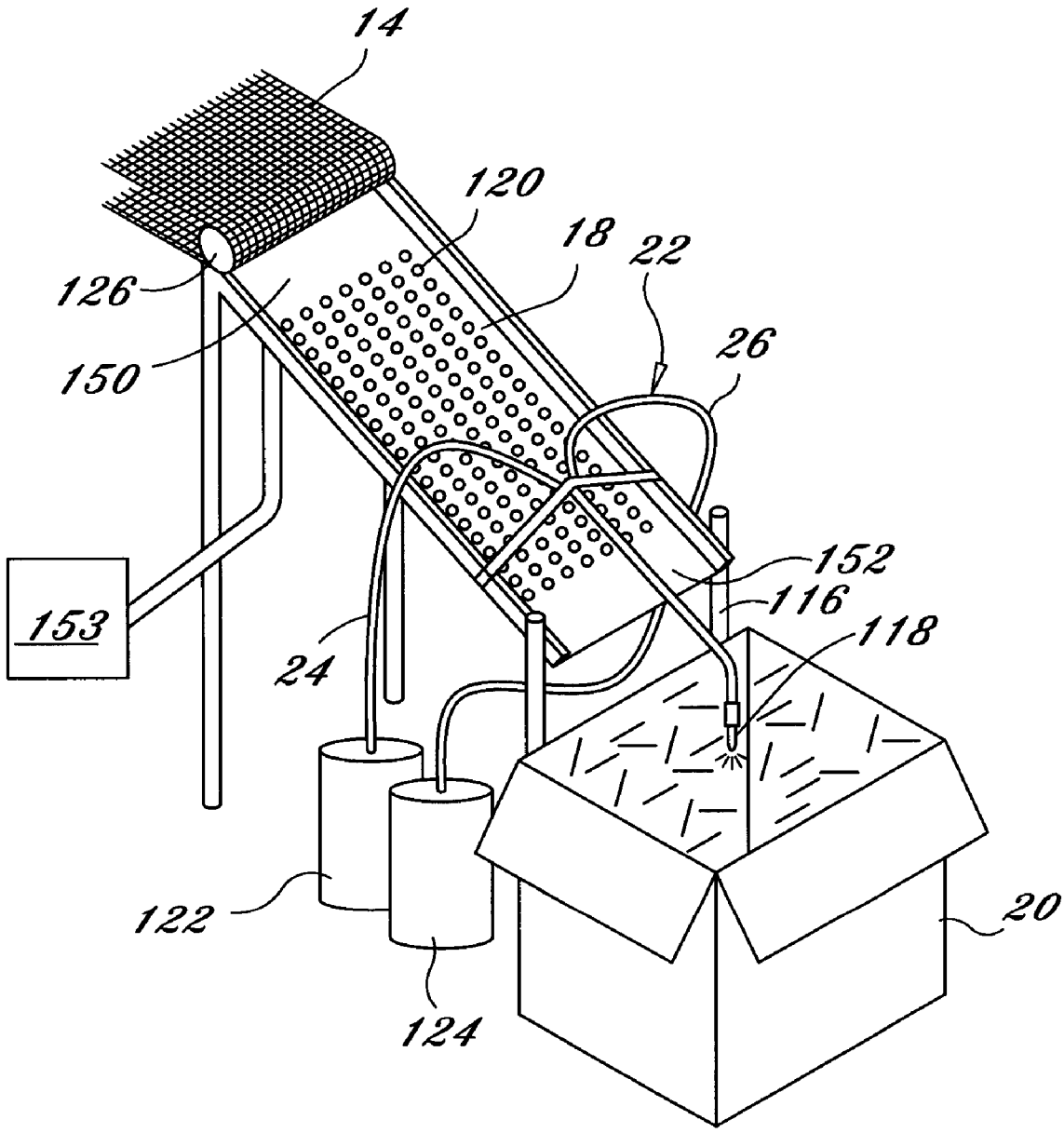
FIG. 2 shows a rear perspective view of the preferred embodiment of the invention having a sifter plate.

It is also preferred that a means for spraying 22 is included in the apparatus 10, as shown in FIGS. 1A, 1B, 2 and 10. The means for spraying 22 is preferably for spraying a liquid having microbicidal, sanitizing, insect repellant, disinfectant and/or deodorizer properties 122. It is also preferred that the apparatus 10 includes a means for dispensing an inert purging liquid 124. Hoses carrying the respective liquids is illustrated in FIG. 2 at 24 and 26. Other liquids are also contemplated for this invention, including dyes, scents, fungicides and/or pesticides. The inert liquid would be used for purging the system if and when it is necessary.

A slitter device is preferred to be a separate device used prior to use of the shredding mechanism 12. However, the slitter may be attached to it. It is preferred that the slitter is portable, wheeled, and height adjustable. The slitter may operate on 110 or three phase voltage, or use any equivalent power source. The slitter is preferably adapted to allow a plurality of different size boxes of corrugated cardboard to be accepted into the shredding mechanism 12. In the preferred embodiment, the slitter includes a means for removing staples, clips or other connectors or foreign materials.

The slitter cuts corrugated cardboard generally with the grain of corrugation. The slitter also preferably uses means for cutting cardboard such as directional guides and cutting disks which are adjustable for slitting corrugated paper into blanks of predetermined widths. The widths are preferably approximately 2 inches to 12 inches across. Corrugated paper is pulled into the slitter by frictional contact with the cutting disks. It is preferred that the disks have flat edges which are knurled to grip the corrugated paper and pull it through the slitter. After passing through the slitter, the resulting slit corrugated paper blank then is caught and accumulated on the opposite side of the intake of the slitter, preferably by means such as a pull-up table.

Figure 3A:
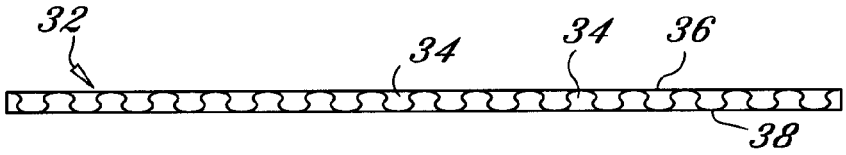
FIG. 3A shows a cross-section view of a single layer strip of the invention before cell expansion for improved latticing.
Figure 3B:
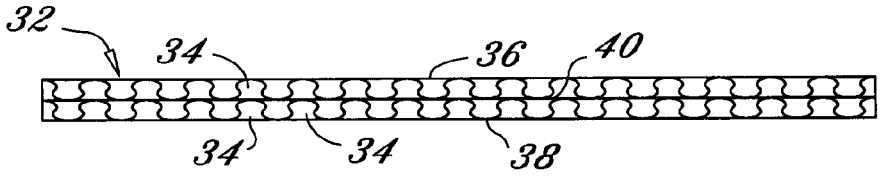
FIG. 3B shows a cross-section view of a double layer strip of the invention before cell expansion for improved latticing.
Figure 4:
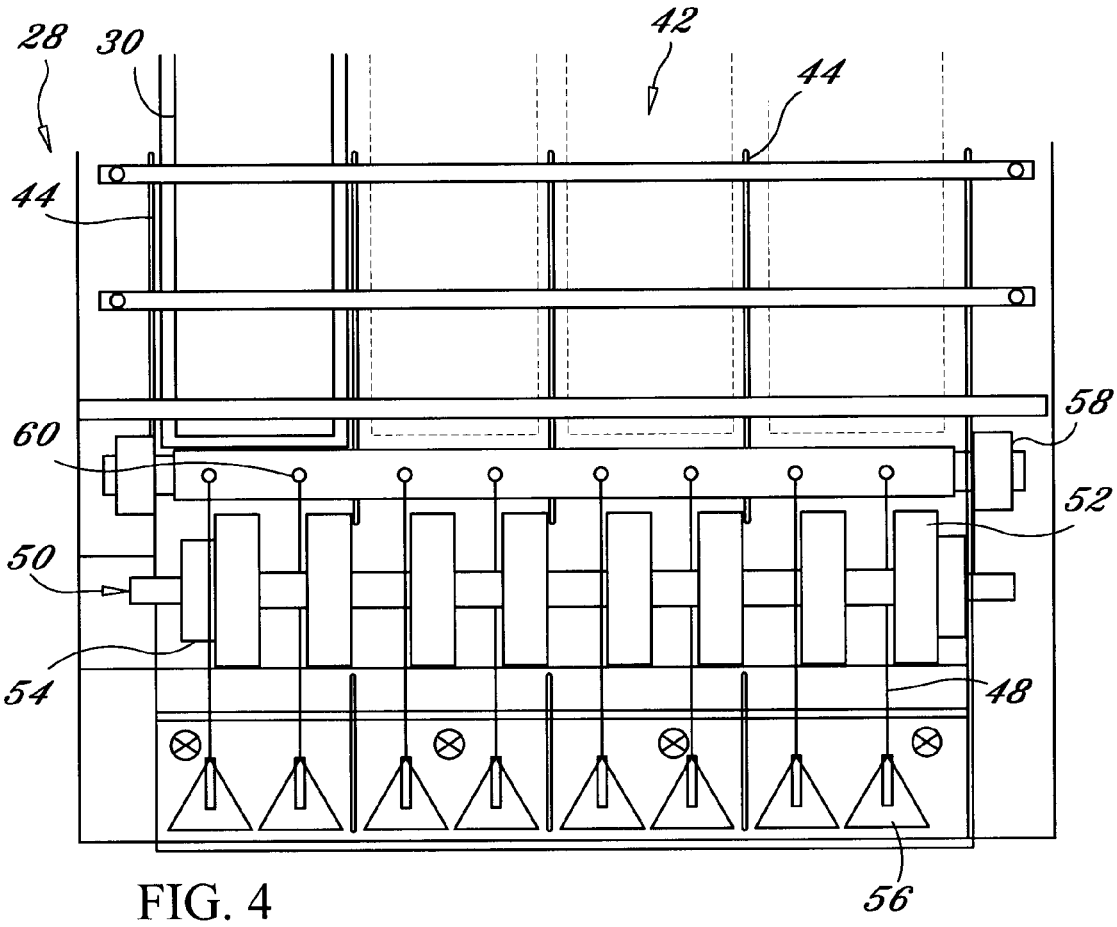
FIG. 4 shows a schematic view of the blank securing mechanism of the invention.

As shown in FIGS. 1A and 1B, and FIG. 4, the apparatus 10 includes a paper input section 28 which receives corrugated paper in the form of slit corrugated paper blanks 30 of a predetermined width. While these blanks 30 may be formed by the slitter, they may be formed in any other equivalent manner. The blanks 30 are slit generally with the grain of the corrugation, and the shredding mechanism 12 cuts generally against the grain of corrugation. Thus, as shown in FIGS. 3A and 3B, in the preferred embodiment, as the shredder device shreds the blanks 30 into strips 32, the resulting strips will have expandable cells 34 between the top board 36 and the bottom board 38. The expansion of the cells 34 improves the latticing effect of the strips, which is one of the important advantages to the strips when used as a packing material. As referenced above, the shredding is preferably performed by cutting using a method having a scissors motion to reduce dust. For double- or multiple-width strips 32, the cells 34 may also expand from one or more middle support boards 40, as shown in FIG. 3B.

Figure 5:
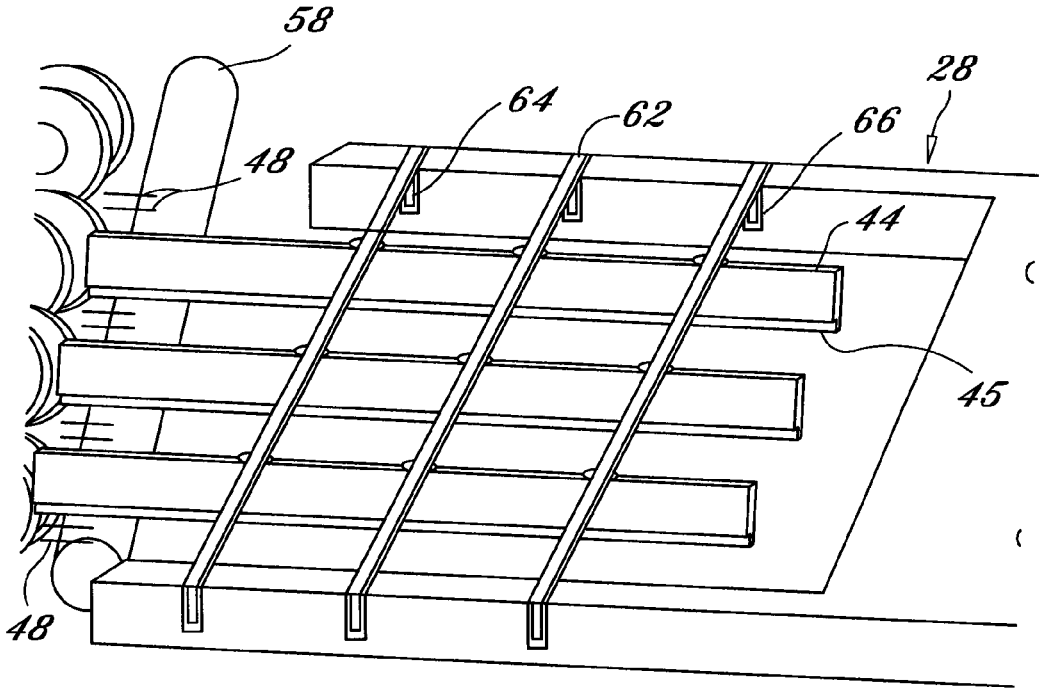
FIG. 5 shows a perspective view of the guide system of the invention.

Referring now to FIGS. 4 and 5, blanks 30 enter at the shredding mechanism inlet 42. Preferably, the blanks follow a means for securing blanks at inlet 42. In the preferred embodiment, rigid guides 44 guide the blanks 30 into the shredder device 12. The guides 44 provide tracks for the blanks 30. The guides 44 generally fit around the blanks 30 to help prevent the blanks 30 from slipping or changing the directional angle of entry as they pass through the shredder device 12. The tracks preferably have horizontal slots 45 complementary to the sides of the blanks for increased security in the guidance of the blanks. It is preferred that the guides lead directly up to the shredder device 12 during the cutting process. The guides 44 lead to the edge of a metal cutting block platen 46, shown in FIG. 6. The guides are preferably made of steel or its equivalent.

Figure 6:
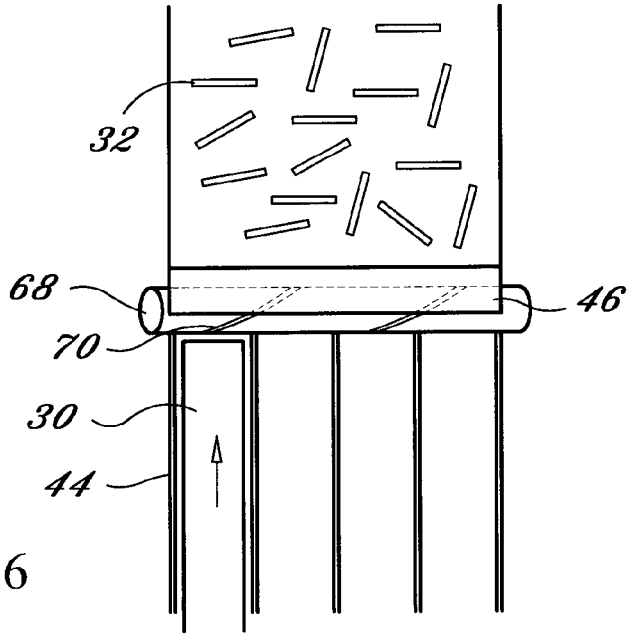
FIG. 6 shows a top view of the preferred embodiment of the blade of the shredding mechanism of the invention.

Also as shown in FIGS. 5 and 6, the guides may alternatively include one or more crossover members 62 to provide stability to the location of the guides 44. The crossover members 62 are preferably made of steel. They are securely connected to the guides 44, preferably by means such as a welding. Steel pins 64 may be welded to the crossover piece, so that the crossover piece may be placed in complementary holes 66 on the periphery of the area where blanks enter the shredder device 12. The periphery may be outside guides. Alternatively, the holes may be located on removable pieces so that the guides may be interchanged to accommodate blanks of different widths.

After entering the guides 44, the movement of each blank 30 is aided by a means for producing tension on the top surface of each blank. On the preferred embodiment, the means for producing tension on each blank is one or more front-end leaf springs 48, as shown in FIGS. 4 and 5. It is preferred that a plurality of springs 48 are located between each set of rigid guides 44. It is also preferred that the means for producing tension is mounted on the front end of the shredding mechanism 12. As shown in FIG. 4, the springs 48 are mounted upon a support 58 at the front end of the shredder device. It is also preferred that each spring 48 is individually adjustable. As shown, an individual adjustment screw 60 is found on each support 58. In an alternative embodiment, a plurality of springs 48 within the rigid guides may alternatively be adjustable together. Thus, blanks of varying thickness can get suitable tension when shredded simultaneously by the apparatus 10. The springs 48 provide pressure on the top of each blank within each guide, thereby helping create enough friction with the blank to insure straight and continuous movement of the blank into the shredding mechanism 12. In addition, suppression pads 56 may be used on the ends of the springs 48. The pads 56 serve to increase and spread the tension force on the blanks 30.

The shredding mechanism 12 preferably has at least one roller 50 as shown in FIG. 4. It is preferred that there is also a bottom roller complementary to an upper roller in a knurled roller system. Upper rolls of the system are mounted on individual shafts, transporting the blanks 30 to the edge of the cutting plate 46 on the opposite side of the rollers. As shown in FIG. 4, one or more upper rolls 52 on the roller 50 impinges upon each blank 30, driving it into the shredding mechanism 12. The roller 50 or a lower roll 54 on the roller 50 may be driven by a motor and pulley system. Alternatively, blanks 30 may be brought to the shredding mechanism 12 by a conveyor or by manual means.

Each blank 30 travels the along the guides and enters the shredding mechanism 12. As shown in FIG. 6, at the end of the cutting platen 46, the shredding mechanism 12 shears the corrugated paper blank, preferably with a rotating blade 68. It is preferred that the shredding mechanism 12 cuts the blanks across the corrugation into elongated paper strips 32. As shown, the preferred mechanism for shredding is a shearing cutting device such as a rotating metal drum with at least one rotating blade 70, which cuts the paper blank with a scissor cutting action. It is preferred that a plurality of blades is used on the drum. Also, other equivalent mechanisms for shredding the blanks are contemplated.

The tension springs 48 are located on the apparatus 10 at a point before the blanks reach the blade to compress the blanks and prevent the blanks from pulling up, rolling over, or otherwise moving while being shredded by the blade or blades on the rotating drum during the shredding process. Other equivalent means for securing the blanks during the shredding process are also contemplated. The preferred springs are a plurality of adjustable tension flat spring fingers that touch each blank, preferably made of a material such as tempered spring steel, which contact the blanks as they approach the cutting platen 46. The plurality of fingers allows for proper tension across the width of the blank, and concurrently secures the blanks during the shredding process. The adjustability of the fingers also allows blanks of varying widths to be properly shredded simultaneously. As stated above, it is preferred that each finger is individually adjustable.

As a portable shredder, the apparatus 10 is capable of being portable by means such as attached wheels 13, shown in FIG. 1B. Alternatively, the apparatus 10 may be placed on a cart.

It is preferred that the blanks are shredded into strips 32 in the range of approximately ⅛ to ¼ inches and 2 to 14 inches long. The thickness of the strips depends upon factors including the flute type of the corrugated cardboard being shredded. Types including single, double and triple walled corrugated cardboard are contemplated for the invention described herein.

It should be understood that the length and width of the material strips 32 produced by shredder device 12 may vary with the type of shredder mechanism employed and the dimensions of the corrugated cardboard sheets. For example, the length of the paper strips 22 could be up to 24 inches, if desired. The above dimensions are therefore given by way of example of the normal or preferred size ranges of paper strips 32 but are not intended to be exhaustive of all possible sizes.

Figure 7A:
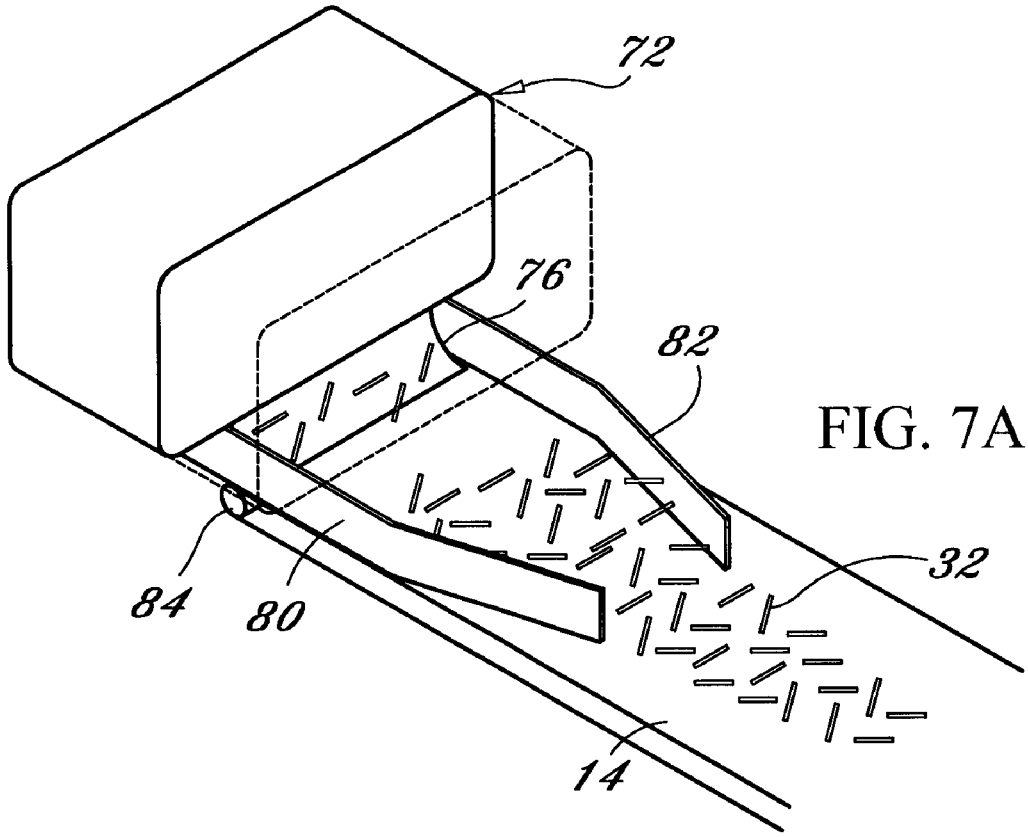
FIG. 7A shows a perspective cutaway view of the centering mechanism of the invention.
Figure 7B:
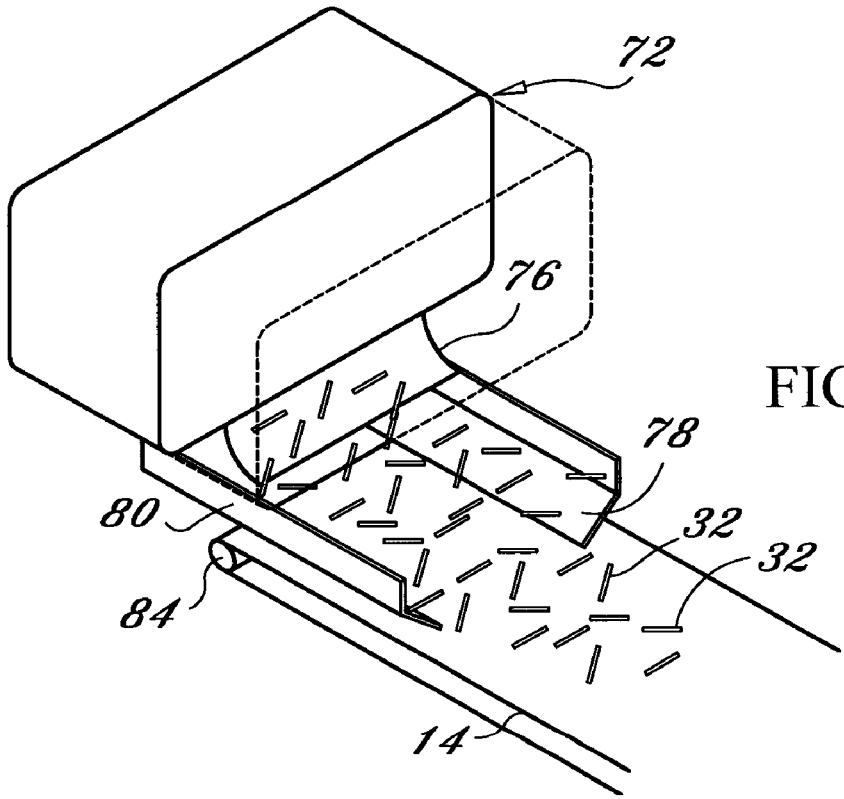
FIG. 7B shows a perspective cutaway view of an alternative embodiment of the centering mechanism of the invention.

The shredding device 12 further preferably includes a drop chute 72 to receive strips 32 after they have passed through the cutting blade 70 of the shredding device 12 as shown in FIGS. 7A and 7B. The drop chute 72 has a ramp 76 from which the strips 32 are removed from the shredding device 12. In the preferred embodiment, at the drop chute 72 are centering members 80 for the output of the shredding device. The centering members 80 center the strips on a conveyor belt 14 leading away from the shredding device. As shown in FIG. 7A, the centering members 80 may be located at the end of outwardly extending arms 82. Alternatively, as shown in FIG. 7B, the centering members 80 may comprise downward sloping members 78. These members may be part of a launch tray overhanging the top portion of the exit area of the shredder device 12. Other means for centering the strips 70 on the conveyor 14 are also contemplated. The centering means preferably will extend from the drop chute 72 and will end before or at the suction housing 90 described below. As shown in FIGS. 1A and 1B, cover 155 may be placed over the strips 32 as they emerge from the drop chute until they enter the vortex box 90, so that openings where strips, dust and foreign materials might fall through are reduced or eliminated, thereby decreasing maintenance and cleaning of the apparatus.

From the drop chute 72, the strips are then placed on a conveyor belt 14 leading away from the shredder device 12. It is preferred that the conveyor belt 14 is made of fiberglass and treated with a composite material such as Kevlar, or made of an equivalent material. It is also preferred that the conveyor belt 14 has perforations in it to catch the strips. In the preferred embodiment, the conveyor belt 14 is a mesh.

The conveyor belt 14 preferably includes a driven pulley having a friction ring, preferably made of a material such as rubber, extending outward from the pulley sheave which is connected to a drive pulley. It is preferred that the drive pulley is a wide sheaved pulley to maximize the driven pulley friction. It is also preferred that the drive pulley is located within a housing 105 of the shredding device 12 so that it is not exposed to strips, tabs, dust or foreign materials.

Figure 8A:
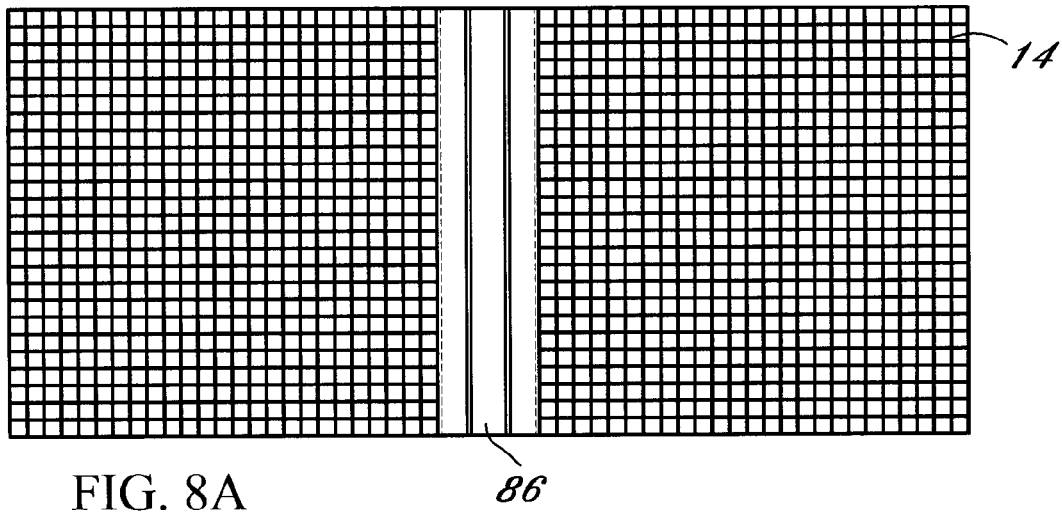
FIG. 8A shows a top view of the cleated perforated conveyor of the invention.
Figure 8B:
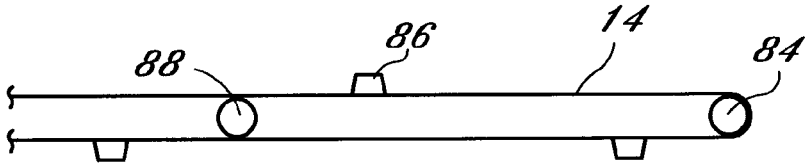
FIG. 8B shows a side view of the cleated perforated conveyor of the invention.

Furthermore, in the preferred embodiment, the drive pulley is in mechanical communication with a motor. The drive pulley is positioned to optimize the friction on one or more drive belts between one or more driven pulleys in the apparatus. In an alternative embodiment rollers for the blanks entering the shredder device 12 are driven by the drive pulley. The drive pulley is preferably also drivingly connected to a belt and the rotating drum of the blade of the shredder device, described above. A third pulley is preferably used to drive frictionally a conveyor drive roller 84 for the conveyor 14 located at the outlet of the shredder device 12, as shown in FIGS. 7A and 7B. The conveyor drive roller 84 carries the endless belt conveyor 14. It is also preferred that the belt conveyor 14 includes cleats 86, as shown in FIGS. 8A and 8B. The cleats may be rectangular, rounded, or of another shape. The drive pulley preferably includes bearing collars and adjustable mounts for the conveyor pulley shaft. The conveyor pulley shaft aids in guiding the tracking of the cleated conveyor 14 and helps adjust the friction of the conveyor drive pulley, thereby reducing the risk of slippage of the drive shaft that moves the conveyor 14.

The conveyor 14 is driven by the drive roller 84 and is supported by one or more idler rollers 88 and an ending idler roller 126 located at the discharge end of the conveyor, as shown in FIG. 2. It is preferred that the conveyor 14 is at least partially enclosed by a frame 91 for an outlet of a suction housing discussed below. It is also preferred to be located on a support stand 91 located generally at the discharge end of the conveyor 14. The support stand 91 is provided with a means for adjustment 111, such as steps or rungs which are spaced apart and are adapted to releasably attach to the discharge end of the conveyor 14. Thus, the conveyor 14 is adjustable in slope and may be positioned at different angles from a horizontal position, as desired.

Figure 9A:
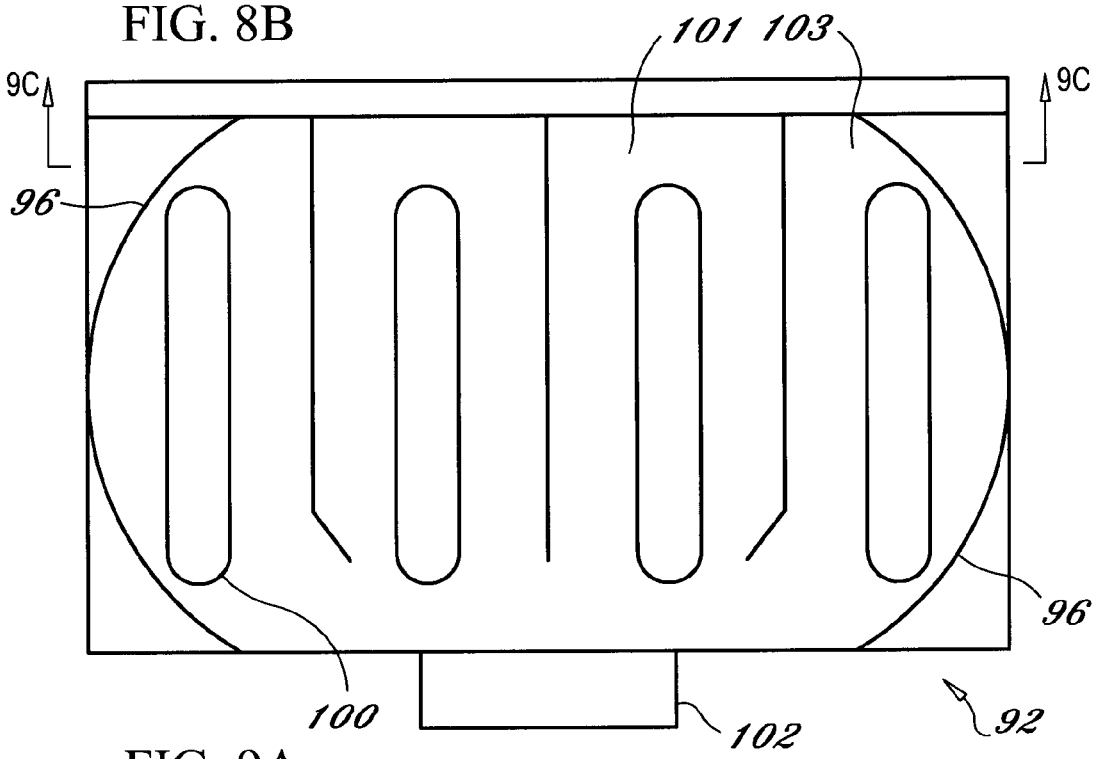
FIG. 9A shows a top view of the vortex box of the invention.
Figure 9B:
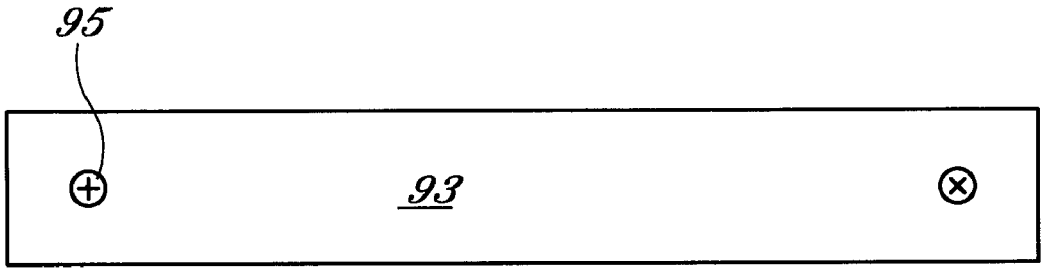
FIG. 9B is a side elevational view of the cover plate to the vortex box.

In accordance with FIGS. 1 and 9A-B, the suction device 16 comprises the suction housing 90 of the apparatus 10. The suction device 16 creates a voluminous force of downward air pressure impinging upon the strips on the conveyor, pulling ambient air in and through the vortex box 92.

Figure 9C:
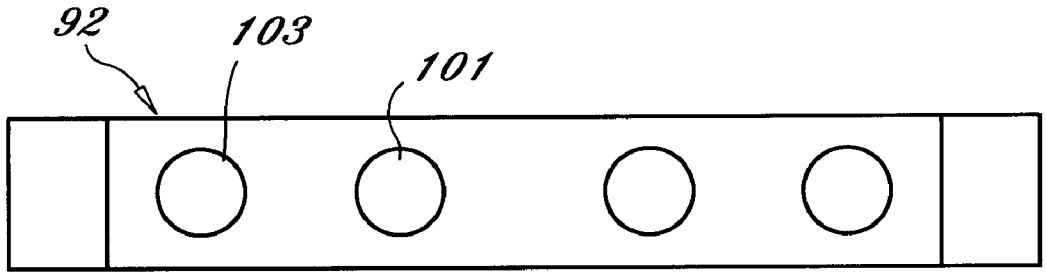
FIG. 9C shows a side view of the cleaning vents of the vortex box of the invention.
Figure 9D:
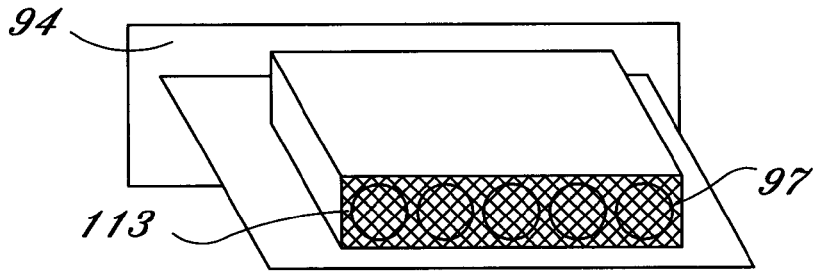
FIG. 9D is an exterior schematic view of the top of the vortex box.

The suction housing 90 is located at the outlet side of the shredder device 12 in a position to substantially enclose at least a portion of the conveyor 14, as shown in FIG. 1. The vortex box 92 is located within the interior of the suction housing 90 and is shown in FIGS. 9A and 9C. The suction housing 90 has an upper portion 94 located above the top surface of the perforated conveyor belt 14. Fans 113, as found in the preferred embodiment, are located in the upper portion 94 of the suction housing, as shown in FIG. 9D. The suction housing 90 further includes curved interior periphery corners 96, shown in FIG. 9A, for the creation of a vortex within the suction housing 90. The rounded corners 96 decrease resistance in the flow of air drawn through the vortex box 92. Means for enhancing the vortex effect, such as parallel interior elements 100 are preferably used within the vortex box. A lower portion 98 of the suction housing 90 is preferably mounted to the upper portion 94, so that a downward flow of air is impinging upon the elongated strips as they travel on the conveyor 14. In the preferred embodiment, the elements 100 are located in the interior of a bottom portion of the suction housing 90.

Furthermore, the exhaust of the suction device 16 may be connected to the suction housing 90 to provide a positive downward force of air above the strips 32 traveling along the conveyor 14. Thus a positive downward airflow is provided from above simultaneously with the negative air flow from below. Thus, there is a synergistic enhanced effect of the air flow upon the strips, providing an enhanced cleaning action upon them. The air from the vortex box 90 carries dust and other contaminants through the perforated conveyor belt 14 into one or more of vents to the vortex box 90. The vortex box 90 then removes the air carrying the contaminants to the one or more outlets 102 of the vortex box. The air and contaminants are then transferred, preferably by conduit, to a collection drum or collection bag 108.

As shown in FIG. 9A, the vortex box 92 is preferably rectangular in configuration, having a plurality of chambers in the interior of the bottom portion serving as vents wherein pressure of the air impinging upon the strips is optimized. A plurality of chambers 101 between the elements 100 and between the elements and the curved walls 103 are located on the interior surface of the vortex box, thereby optimizing the pressure on the conveyor. Equal spacing of the chambers reduces the need for the strips 32 to undergo further cleaning.

Each individual chamber preferably has individual outlets within the vortex box, as shown in FIG. 9C. Each outlet empties its stream of air into the main corridor of the vortex suction opening port 102. The plurality of opening ports helps create an air vortex as contaminate-filled air flows through an outlet port and directly into the conduit 110 of the suction device without bends or turns that can create air resistance and turbulence in the air flow. Heavier contaminants in the air are then deposited in a drum. Lighter contaminants such as paper, dust, tabs and tailings may be deposited in a separate collection bag 108, as shown in FIGS. 1A and 1B.

The internal geometry of the vortex box 92 also has the effect of preventing large contaminants from blocking the flow of air, thereby reducing the need for stopping operation of the shredding device during cleaning. Moreover, a side panel plate 93 which is capable of being opened or detached as shown in FIG. 9C may be preferred to allow isolation of the vortex box 92 during operation and to provide access for cleaning and maintenance of the interior of the vortex box 92. The plate 93 is preferably removably attached by means such as screws 95 or their equivalent.

As depicted in FIG. 1B, the airflow pushes downward over the strips. Thus, the dust and dirt outlet of the suction housing may alternatively be connected by a duct 110 or conduit to a split inlet 109 for the suction device. Preferably, the split inlet 109 includes conduit of an exterior suction device which mounts on top of a collection drum with a collection bag that works in concert to create a suction bag. Thus, the suction device creates negative pressure, within the suction housing 90 to assist in the decontamination of the strips formed by the shredding device.

In an alternative embodiment, the centering device for centering the strips on the conveyor may be placed at the output end of the suction housing.

A sifter plate 18 is located at the discharge end of the conveyor 14. In one embodiment, the sifter plate 18 is attached to the frame of the conveyor by a hinge mechanism 115. On top of the inlet end of the sifter plate 18, as described below, an adjustable cover plate 114 may be mounted. As shown in FIG. 2, in the preferred embodiment the outlet end of the sifter plate 18 is connected to support arms 116 which orient the sifter plate 18 in a downwardly angled position from the discharge end of the conveyor 14 to the collection hopper 20. The sifter plate 18 is preferably detachably connected to both inlet and outlet support arms. As shown in FIG. 2, the sifter plate may include smooth areas for decreasing friction on the strips as they travel along the sifter plate 18. It is preferred that the sifter plate includes a drop off zone 150 on the upper end and a drop zone 152 on the lower end. Also a spraying device 22 is preferably located at the lower end of the sifter plate 18, to dispense a chemical spray with a nozzle 118. The spraying device is mounted to the sifter plate 18, flat plate 19, or the frame of its apparatus. A vibrating device 153 is preferably mounted to and under the sifter plate 18 and may be used to vibrate the sifter plate 18 during operation of the apparatus 10 to ensure the continuous flow of strips 32 as they pass over the sifting field of holes 120 and reduce the risk of jams caused by the latticing of the strips 32. The vibration also aids in removing any remaining contaminants from the strips 32.

The sifter plate 18 is formed with a number of holes 120 which are preferably round but may be oval, square, rectangular, or other geometric or non-geometric shapes. It is also preferred that the diameter of the openings in the sifter plate 18 are approximately ¼ to ½ inch to permit the passage of short strips and tabs while minimizing any blocking due to latticing. A waste bin may be positioned beneath the sifter plate to catch the contaminants dislodged by the sifting of the strips 70.

Figure 10:
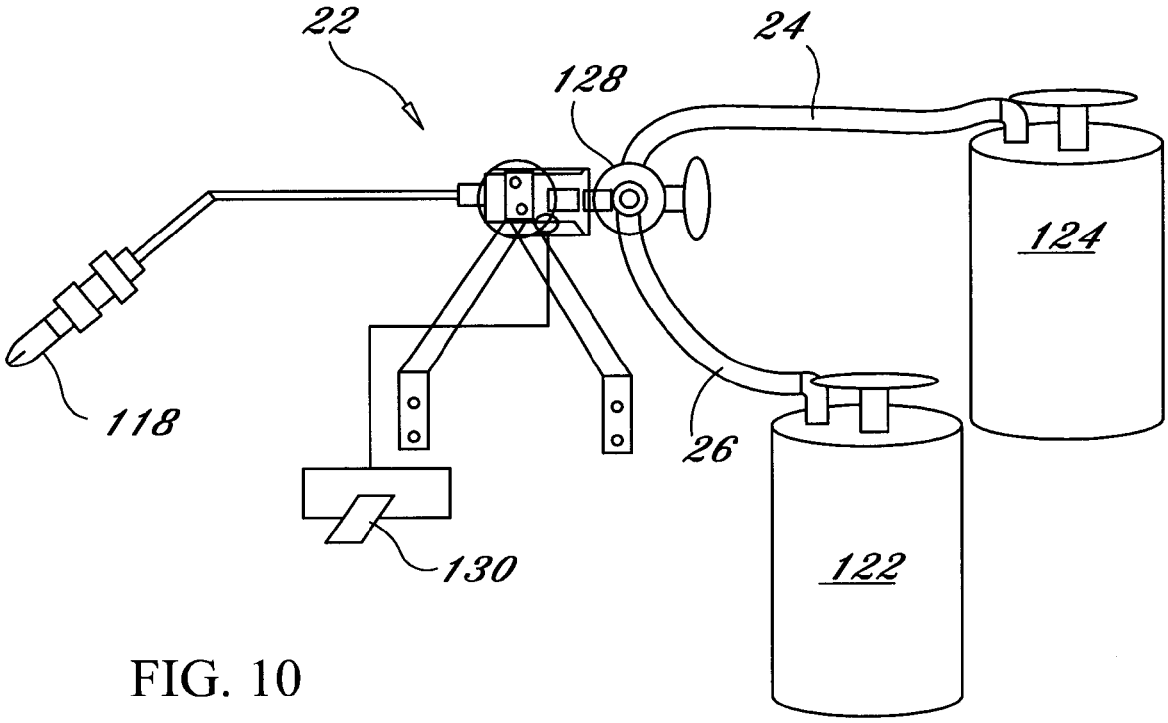
FIG. 10 shows a schematic view of the spray system of the invention.

The preferred spray system is shown in FIGS. 2 and 10. The spray system uses a spray device 22 and tanks of material to be sprayed. In the preferred embodiment, one or more means for holding the tanks are made part of the frame of the apparatus, so that the tanks are not required to be removed from the apparatus when it is moved. The spray device 22 may preferably be moved and positioned at the outlet of the conveyor when the device is used with a bagging operation.

The means for holding the tanks is preferably a frame made of steel. It may be preferred that the tanks are pressurized; however, this is not required. In the preferred embodiment, a first tank 122 is filled with a treatment material for the strips while a second tank 124 is filled with a material for purging the spray system. As shown in FIG. 2, the tanks 122, 124 may be placed between the support legs 116 of the sifter plate and/or beneath the discharge end of the end roller 126 of the conveyor 14. As shown in FIG. 10, the spray device 22 preferably includes a nozzle 118 with a selector valve 128. The valve 128 is preferably a 3-way ball valve, although equivalent valves may be used. It is also preferred that separate electrical switch device, incorporating activating means such as a foot pedal 130 or a toggle switch is used to activate the nozzle 118 to apply the liquid treatment material within the tank 122 onto the paper strips 32. Several tanks for several multaneous or consecutive treatments may also be used.

In the preferred embodiment, the spray device includes a flexible hose and nozzle and a contaminant trap which may be purged and/or cleaned. The contaminant trap is used to remove paper and other contaminants. However, a non-flexible spout hose, or the equivalent, may alternatively be used.

The purging liquid 124 is used to clean residue of the treatment material within the spraying device 22. The purging liquid may be water or any other solvent for removing residue. Preferably, the liquid treatment material within tank 122 has one or more of the following properties: microbicidal, sanitizing, insect repellant, dyeing, disinfectant and deodorizing.

For an apparatus capable of converting four four-inch blanks simultaneously, a conveyor approximately 16 inches across is preferred, with a sifter plate of approximately the same size. The holes in the sifter plate preferably have an internal diameter of approximately 0.5 inches, and have approximately 0.5 inch spacing between the holes. An optimal length of the sifter plate is approximately 24-48 inches.

Within the vortex box 92, it is preferred that the members 100 are approximately 1 and ⅛ inches wide and 3 and ¾ inches apart. It is also preferred that the intake from the suction device is generally rounded and approximately 6 inches in diameter. However, equivalent measurements for substantially the same results are also contemplated. Moreover, for different size strips, and for different capacity devices, these parameters are to be varied accordingly.

The operation of apparatus 10 proceeds as follows. It is contemplated that in many applications, corrugated paper from used shipping containers and the like will be utilized to form the paper strips 32 of this invention. Preferably, all staples, tape and any other foreign materials are removed from such corrugated cardboard sheets before being input to the shredder device 12.

As noted above, a portable slitter device having a means to extract staples, clips and undesirable foreign materials from the edges of the corrugated paper blanks may be used to form blanks for shredding. The shredding mechanism is effective to shear the corrugated paper blank with a scissor cut motion to form the elongated strips. Strips are then placed within the guide system before entering the suction housing. The shredding device emits the strips onto the center part of the moving cleated conveyor belt.

In the course of the shredding operation, a quantity of containments is formed or dislodged, some of which remains on the paper strips after they have passed through the shredding mechanism. A suction device is preferably operated on the shredding mechanism while it is in operation. Blowing devices mounted on top of a suction housing blow air downward, impinging upon the strips as they travel on the cleated perforated conveyor belt. The perforations in the conveyor belt allow the air to pass through the conveyor.

In a synergistic configuration, a suction device creates negative air pressure or suction through a conduit, creating a vortex around the strips removing the containments.

In one embodiment, shown in FIG. 1B, suction is directed to a cover of the shredding mechanism. Thus, in addition to the vortex, negative air pressure is provided in the area of the shredding mechanism, whereby contaminants inside the shredding device are removed. Thus the shredded strips are doubly cleaned, and the decreased containments reduces the need for vent on the apparatus.

However, the negative pressure within the shredding mechanism further helps prevent containments from appearing at discharge chute of the shredding device.

When such is applied to the shredding mechanism the amount of suction is preferably less than that used for the vortex box 92. It provides negative air pressure to the vortex box within the suction housing. The suction housing includes suction as well as positive air pressure from fans. This creates a synergistic effect increasing the amount of air passing over the strips, creating a push-pull effect of air that impinges the strips. The air also passes through the perforated belt, and is trained by the vortex box. All material entrained within the air flow is moved forcefully through routing chambers in the interior of the vortex box by the enhanced suction created by the geometry of the interior of the vortex box.

The air entrained containments exit the vortex box and flow through a conduit or ducting into a collector bag. Because the enclosed suction housing is located at the outlet of shredding mechanism, there is reduced dust and debris escaping in the ambient air, and the strips are substantially cleaned even before exiting the suction housing.

The conveyor at the discharge end of the shredding mechanism is cleated to function as a cleaning device as it moves the strips in the presence of the air flow. It sweeps up and collects strips that have latticed. Without the cleating the strips would jam the conveyor, thereby possibly requiring a shut-down.

Clinging dirt or dust drops through the belt, and may be collected in a collection device located under the conveyor. It is preferred that there is a plurality of cleats on the conveyor; however, one cleat may be used. Cleats may be attached by gluing, sewing, welding or equivalent means. Furthermore, they may be formed simultaneously with or directly onto the belt. The size of the cleat is optimized to collect and move the strips as they are placed on the conveyor. The cleats are preferred to be approximately ½ inch in height and 1 inch in width. The conveyor belt is preferably made of a material such as fiberglass covered with a composite such as Kevlar. However, other equivalent materials are also contemplated.

The present invention, with its guides and securely held blanks, minimizes the amount of short, irregular or too-wide strips produced. The vortex and the guide system creates an efficient, reliable and fast shredding device. The guide system holds the blanks in place for the shredding, so there is minimization of any shifting, creeping or sliding of the blanks as they move toward the shredding device. The multiple suppression members hold the blanks in place for cutting. Because the members are adjustable, the blanks may be of any thickness. The members are adapted to be able to rise and fall with the thickness of the blank being fed into a guide.

Any contaminants that are too large to pass through the holes in the perforated belt under the application of the suction will continue to move along the cleated perforated belt to its discharge end. In order to separate larger items from the strips, and to discharge additional dust and dirt, a sifter plate is preferred to be placed at the discharge end of the conveyor. The sifter plate is in communication with a vibrating device in mechanical communication with the sifter plate. When activated, the vibrating device vibrates the sifter plate. Containments fall through holes in the sifter plate. Short or non-uniform strips fall through the holes, preferably into a waste hopper. It is preferred that the hopper is adapted to fit underneath the sifter plate. Properly formed strips travel across the sifter plate into a collection hopper. The sifter plate"s generally smooth sections decrease friction and allow the strips to flow rapidly over the sifter plate.

Preferably, as the paper strips are leaving the sifter plate, or when they are first deposited into the collection hopper, a spray nozzle, activated by an electrical switching device, such as a toggle or foot switch, applies liquid material from a tank onto the paper strips. As noted above, this liquid is preferably environmentally safe and contains a number of properties such as dyeing, microbicidal, sanitizing, insect repellant, disinfecting and deodorizing.

Preferably, the liquid material is sprayed onto the paper strips in a fine mist from a nozzle so that a coating of approximately less than about 1 millimeter in thickness is obtained thereon. As a result, the paper strips within collection hopper are not only "cleaned" of any dust, dirt or other foreign materials, but are also coated with a material to dye, sanitize, or otherwise make them more suitable for use as packing material.

While the invention has been described with reference to a preferred embodiment, it will be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof.

For example, the method of slitting the corrugated blanks is described above and the manual entry of the slit blanks into the guides of the shredding device. Also, a means for centering the strips after passing through the shredding device is taught to increase efficiency and eliminate waste.

It is also contemplated to have the compact apparatus on wheels for transporting the device from location to location, if desired. Furthermore, it is contemplated that some or all of the elements to the embodiments described herein may be combined to provide a novel apparatus which is a previously unknown improvement over the prior art.

Therefore, it is intended that the invention not be limited to the particular embodiment disclosed as the best mode contemplated for carrying out this invention, but that the invention will include all embodiments falling within the scope of the appended claims.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A compact apparatus for forming strips of material suitable for use in packing, comprising:

a shredding mechanism device including a means for securing blanks operative to form material strips therefrom;

a conveyor having a perforated belt movable between an input position at which material strips from said shredder device are placed atop said perforated belt, and a discharge position where the material strips are discharged from said perforated belt; and means for removing contaminants from the material strips.

2. The apparatus of claim 1, further comprising a slitter for slitting corrugated cardboard into blanks of predetermined size before placement on the means for securing blanks.

3. The apparatus of claim 2, wherein the slitter is adapted for creating blanks of approximately four inches in width.

4. The apparatus of claim 2, wherein slitter the adapted for automatically feeding the blanks into an inlet of the shredding mechanism.

5. The apparatus of claim 4, wherein the slitter is adapted for the removal of clips, staples and tape and other closure devices from cardboard before slitting.

6. The apparatus of claim 1, wherein the shredding mechanism includes at least one blade, whereby strips are formed from blanks by a scissor cutting motion.

7. The apparatus of claim 6, wherein the blade is located on a roller.

8. The apparatus of claim 1, wherein the means for securing comprises a plurality of parallel rigid guides for the blanks.

9. The apparatus of claim 8, wherein the guides further comprise at least one generally horizontal slot complementary to a corresponding side of the blank.

10. The apparatus of claim 8, further comprising a knurled roller system for impinging upon the top surface of the blank.

11. The apparatus of claim 8, further comprising a plurality of means for producing tension on a blank.

12. The apparatus of claim 11, wherein the means for producing tension comprises at least one front end leaf spring.

13. The apparatus of claim 12, wherein each leaf spring further comprises at least one suppression pad.

14. The apparatus of claim 12, wherein the tension from the spring is adjustable.

15. The apparatus of claim 8, wherein the guides are adjustable so that the width of the blanks entering the apparatus is adjustable.

16. The apparatus of claim 8, wherein the guides further comprising a crossover member.

17. The apparatus of claim 1, wherein the shredding mechanism further comprises a centering construct for centering strips on an input end of the conveyor.

18. The apparatus of claim 17, wherein the centering construct is attached to a drop chute at an output end of the shredding mechanism.

19. The apparatus of claim 1, wherein said conveyor passes through said means for removing contaminants and suction occurs below the strips.

20. The apparatus of claim 1, wherein the conveyor comprises one or more cleats optimized for moving strips from the output end of the shredding device.

21. The apparatus of claim 20, wherein the conveyor comprises a fiberglass, Kevlar coated webbing.

22. The apparatus of claim 1, further comprising an angled perforated sifter plate located at the discharge end of the conveyor.

23. The apparatus of claim 22, wherein the sifter plate is in mechanical communication with a means for vibrating, whereby the sifter plate is vibrated to remove contaminants.

24. The apparatus of claim 22 wherein the sifter plate includes an upper end, a lower end and a generally smooth drop zone located at the upper end.

25. The apparatus of claim 24 wherein the sifter plate further comprises a generally smooth drop off zone located at the lower end.

26. The apparatus of claim 1 further including means for spraying a liquid having microbicidal, sanitizing, insect repellant, disinfectant and deodorizing properties onto the material strips.

27. The apparatus of claim 26, wherein the means for spraying further includes a means for dispensing a purging liquid.

28. The apparatus of claim 27, wherein the means for spraying and the means for dispensing a purging liquid comprise a ball valve.

29. The apparatus of claim 1, further comprising a mechanical induced air pressure within a tank of purging liquid activated by an electrical switching device.

30. The apparatus of claim 1, wherein the apparatus further comprises wheels for transportation.

31. The apparatus of claim 2, wherein the slitter further comprises adjustable rotating cutting disks for forming blanks.

32. The apparatus of claim 26, wherein the means for spraying further comprises a frame for holding one or more tanks of liquid.

* * * * *